US011500408B2

(12) United States Patent
Tanaka

(10) Patent No.: US 11,500,408 B2
(45) Date of Patent: Nov. 15, 2022

(54) REFERENCE VOLTAGE CIRCUIT

(71) Applicant: ABLIC Inc., Tokyo (JP)

(72) Inventor: Toshiyuki Tanaka, Tokyo (JP)

(73) Assignee: ABLIC INC., Tokyo (JP)

( * ) Notice: Subject to any disclaimer, the term of this patent is extended or adjusted under 35 U.S.C. 154(b) by 144 days.

(21) Appl. No.: 17/158,379

(22) Filed: Jan. 26, 2021

(65) Prior Publication Data

US 2021/0247794 A1 Aug. 12, 2021

(30) Foreign Application Priority Data

Feb. 7, 2020 (JP) ..... JP2020-019709

(51) Int. Cl.
*G05F 3/26* (2006.01)
*G05F 3/02* (2006.01)
*G05F 3/08* (2006.01)

(52) U.S. Cl.
CPC ..... *G05F 3/262* (2013.01); *G05F 3/02* (2013.01); *G05F 3/08* (2013.01)

(58) Field of Classification Search
CPC ..... G05F 3/02; G05F 3/08; G05F 3/262
USPC ..... 323/313
See application file for complete search history.

(56) References Cited

U.S. PATENT DOCUMENTS 7,135,913 B2 * 11/2006 Min ..... G05F 3/30 327/539
10,831,228 B2 * 11/2020 Acar ..... G05F 3/267
2010/0156386 A1 * 6/2010 Imura ..... G05F 3/242 323/313

FOREIGN PATENT DOCUMENTS

JP H03-180915 A 8/1991

* cited by examiner

*Primary Examiner* — Yemane Mehari
(74) *Attorney, Agent, or Firm* — Crowell & Moring LLP

(57) ABSTRACT

Provided is a reference voltage circuit including a first MOS transistor to a sixth MOS transistor, a first resistor and a second resistor, a current source circuit, and an output terminal. Five of the transistors form a differential transconductance amplifier, and an input transistor of the differential transconductance amplifier operates in the manner of weak inversion operation.

6 Claims, 5 Drawing Sheets

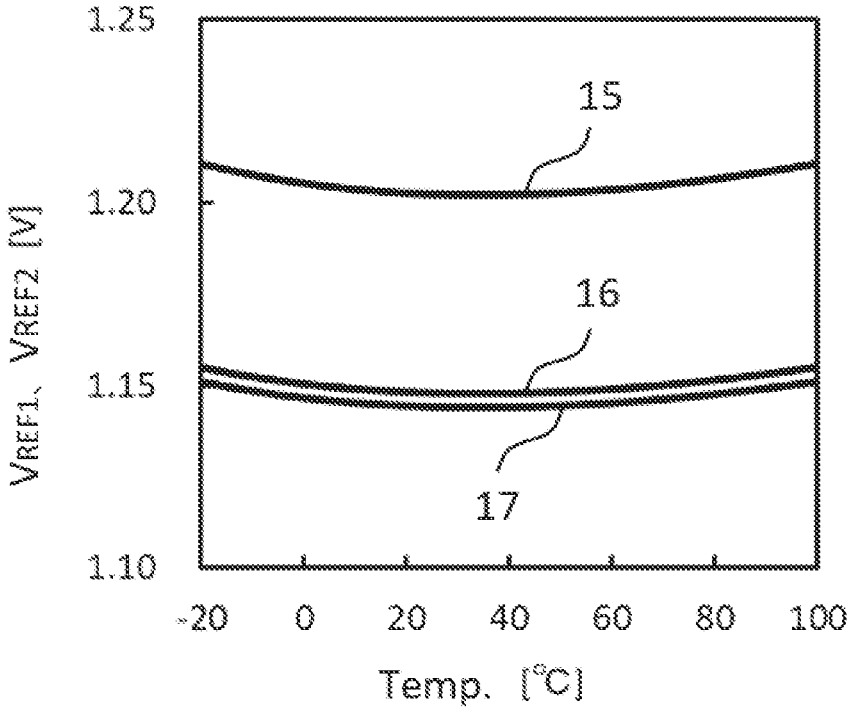
FIG. 4
FIG. 5
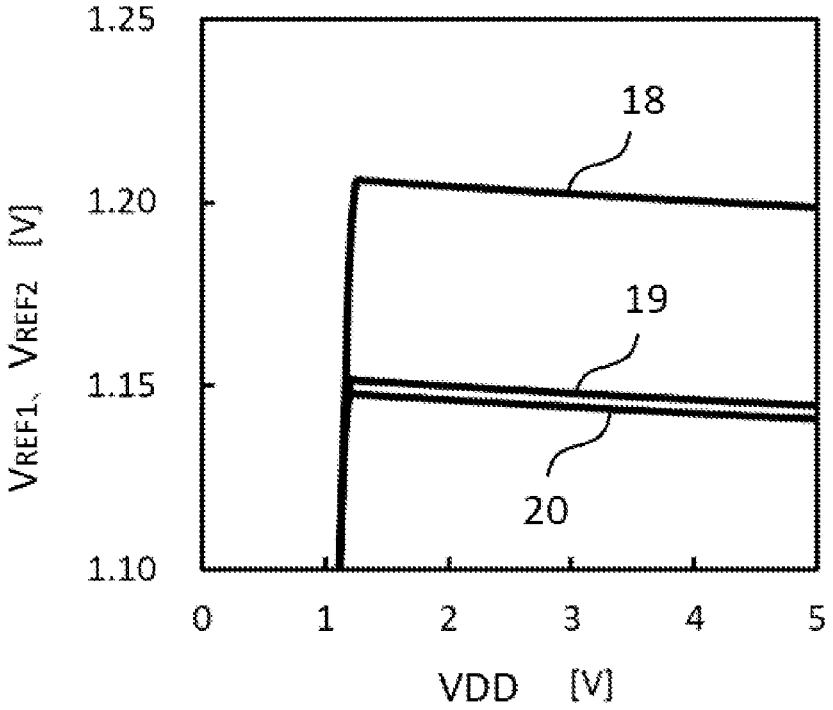

Related Art

REFERENCE VOLTAGE CIRCUIT

RELATED APPLICATIONS

This application claims priority to Japanese Patent Application No. 2020-019709, filed on Feb. 7, 2020, the entire content of which is incorporated herein by reference.

BACKGROUND OF THE INVENTION

1. Field of the Invention

The present invention relates to a reference voltage circuit.

2. Description of the Related Art

In an IoT device or the like, a reference voltage circuit formed on a semiconductor chip is used, and is accordingly required to have an output voltage that is stable irrespective of fluctuations in ambient temperature and in power supply voltage, and to operate on minute power.

A widely used reference voltage circuit is a band gap reference circuit (hereinafter referred to as "BGR circuit"). The BGR circuit utilizes characteristics in which a collector current is in proportion to an exponent of a base-emitter voltage and an area of the emitter, to thereby have an advantage of being able to generate a voltage at which a first-order temperature coefficient is zero. The BGR circuit is therefore widely used as a reference voltage circuit.

There has also been proposed a reference voltage circuit that uses no bipolar transistor and includes MOS transistors alone.

A reference voltage circuit illustrated in FIG. 6 includes NMOS transistors 21 and 22, PMOS transistors 23 and 24, a current source circuit 25, resistors 27 to 29, and an output circuit 26.

In the reference voltage circuit illustrated in FIG. 6, the NMOS transistors 21 and 22 form a differential amplifier. The NMOS transistors 21 and 22 have different threshold values or the same threshold value and different channel width (W). This circuit generates a desired output voltage VOUT by adjusting, with a resultant input offset voltage of the differential amplifier, namely, a voltage between terminals of the resistor 28, being used as a reference, the ratio of resistance values among the resistor 27, the resistor 28, and the resistor 29 (see Japanese Patent Application Laid-open No. Hei 3-180915, for example).

A reference voltage circuit used in an IoT device or the like is required to operate on minute power and generate a voltage that is stable irrespective of fluctuations in ambient temperature and in power supply voltage.

SUMMARY OF THE INVENTION

According to one embodiment of the present invention, there is provided a reference voltage circuit including: a first MOS transistor, a second MOS transistor, a third MOS transistor, a fourth MOS transistor, a fifth MOS transistor, and a sixth MOS transistor; a first resistor and a second resistor; a current source circuit; and an output terminal, wherein the first MOS transistor and the second MOS transistor each have a source terminal to be connected to a first terminal of the current source circuit, wherein the second resistor has a first terminal to be connected to a drain terminal of the sixth MOS transistor and to the output terminal, and a second terminal to be connected to a gate terminal of the first MOS transistor and to a first terminal of the first resistor, wherein the first resistor has a second terminal to be connected to a gate terminal of the second MOS transistor and to a drain terminal and a gate terminal of the third MOS transistor, wherein the first MOS transistor to the third MOS transistor each have a back gate terminal to be connected to a first predetermined potential, the third MOS transistor has a source terminal to be connected to the first predetermined potential, and the current source circuit has a second terminal to be connected to the first predetermined potential, wherein the fourth MOS transistor has a drain terminal to be connected to a gate terminal of the fourth MOS transistor, to a drain terminal of the first MOS transistor, and to a gate terminal of the fifth MOS transistor, wherein the fifth MOS transistor has a drain terminal to be connected to a drain terminal of the second MOS transistor and to a gate terminal of the sixth MOS transistor, and wherein the fourth MOS transistor to the sixth MOS transistor each have a source terminal and a back gate terminal to be connected to a second predetermined potential.

The reference voltage circuit of the present invention includes MOS transistors, operates on a minute current, and can generate a voltage that is as stable as that of a BGR circuit of the related art with respect to temperature fluctuations and fluctuations in power supply voltage.

BRIEF DESCRIPTION OF THE DRAWINGS

FIG. 4 is a graph for showing characteristics of the reference voltage circuits of the first to third embodiments.

FIG. 5 is a graph for showing characteristics of the reference voltage circuits of the first to third embodiments.

DETAILED DESCRIPTION OF THE PREFERRED EMBODIMENTS

Figure 1:
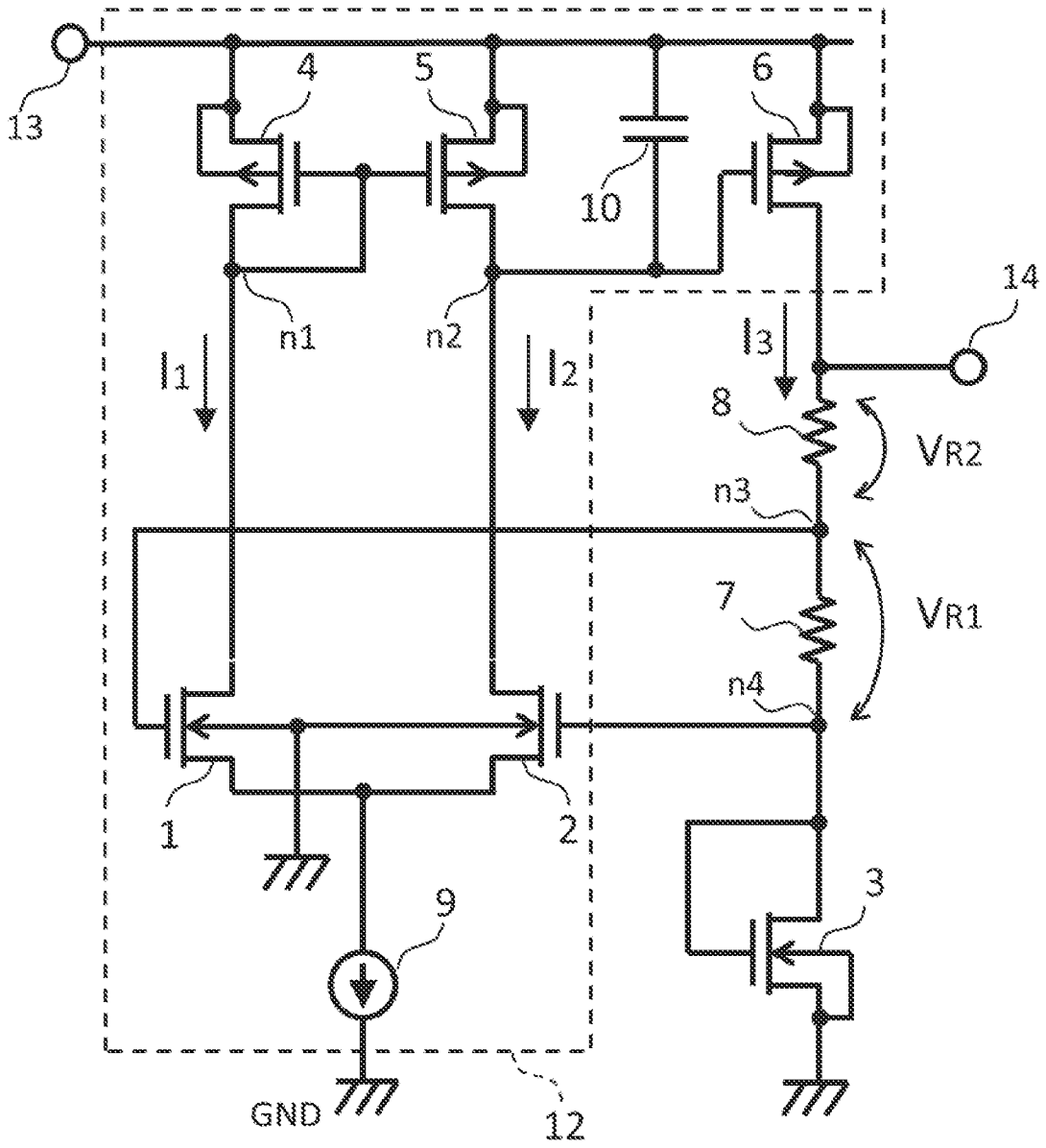
FIG. 1 is a circuit diagram for illustrating a configuration of a reference voltage circuit of a first embodiment of the present invention.

Now, a reference voltage circuit according to the present invention is described with reference to the drawings.

First Embodiment

A reference voltage circuit of a first embodiment of the present invention is described with reference to FIG. 1.

The reference voltage circuit of the first embodiment includes NMOS transistors 1 to 3, PMOS transistors 4 to 6, resistors 7 and 8, a current source circuit 9, a capacitor 10, a power supply terminal 13, a GND terminal, and an output terminal 14.

A power supply voltage VDD is supplied through the power supply terminal 13. The GND terminal is set to a GND potential. An output voltage $V_{REF1}$ is output through the output terminal 14.

The NMOS transistor 1 has a drain terminal connected to a connection point n1, a gate terminal connected to a connection point n3, and a source terminal connected to a first terminal of the current source circuit 9. The NMOS transistor 2 has a drain terminal connected to a connection point n2, a gate terminal connected to a connection point n4, and a source terminal connected to the first terminal of the current source circuit 9. The current source circuit 9 has a second terminal connected to the GND terminal. The NMOS transistor 3 has a drain terminal and a gate terminal that are connected to the connection point n4, and a source terminal connected to the GND terminal. The NMOS transistors 1 to 3 each have a back gate terminal connected to the GND terminal.

The PMOS transistor 4 has a source terminal connected to the power supply terminal 13, and a gate terminal and a drain terminal that are connected to the connection point n1. The PMOS transistor 5 has a gate terminal connected to the connection point n1, a source terminal connected to the power supply terminal 13, and a drain terminal connected to the connection point n2. The PMOS transistor 6 has a source terminal connected to the power supply terminal 13, a gate terminal connected to the connection point n2, and a drain terminal connected to the output terminal 14 and to a first terminal of the resistor 8. The PMOS transistors 4 to 6 each have a back gate terminal connected to the power supply terminal 13. The resistor 7 has a first terminal connected to the connection point n3, and a second terminal connected to the connection point n4. The resistor 8 has a second terminal connected to the connection point n3. The capacitor 10 has a first terminal connected to the power supply terminal 13 and a second terminal connected to the connection point n2.

The NMOS transistors 1 and 2, the PMOS transistors 4 to 6, the current source circuit 9, and the capacitor 10 form a differential amplifier 12. The NMOS transistors 1 and 2 are input transistors, and are driven by the current source circuit 9 in a weak inversion region. The NMOS transistors 1 and 2 are equal to each other in channel length (L), and are set to a channel width (W) ratio of 1:M. The capacitor 10 is a phase compensation capacitor for achieving a stable feedback loop.

The PMOS transistors 4 to 6 form an output stage of the differential amplifier 12. The PMOS transistors 4 to 6 are equal to one another in channel length (L) and channel width (W) both.

The PMOS transistors 4 and 5 form a current minor circuit. The PMOS transistor 4 is diode-connected. A current $I_1$ flowing in the PMOS transistor 4 flows into the NMOS transistor 1. A current $I_2$ is copied as a mirror of the current $I_1$ by the PMOS transistor 5, and flows into the NMOS transistor 2.

A voltage between the gate terminal and source terminal of the NMOS transistor 1 is referred to as "voltage $V_{gs1}$", and a voltage between the gate terminal and source terminal of the NMOS transistor 2 is referred to as "voltage $V_{gs2}$". A voltage $V_{n2}$ obtained by amplifying a voltage that is a difference between the voltage $V_{gs1}$ and the voltage $V_{gs2}$ is generated at the connection point n2. The PMOS transistor 6 converts the voltage $V_{n2}$ into a current $I_3$ and outputs the current $I_3$. The differential amplifier 12 operates as a transconductance amplifier configured to amplify the voltage that is a difference between the voltage $V_{gs1}$ and the voltage $V_{gs2}$ and convert the amplified voltage into the current $I_3$.

Operating principle of the reference voltage circuit of the first embodiment is described.

The current $I_3$ output from the differential amplifier 12 flows into the GND terminal via the resistor 8, the resistor 7, and the diode-connected NMOS transistor 3. The current $I_3$ causes generation of a voltage $V_{R1}$ between terminals of the resistor 7 and generation of a voltage $V_{R2}$ between terminals of the resistor 8. The connection point n3 is connected to the gate terminal of the NMOS transistor 1, and the connection point n4 is connected to the gate terminal of the NMOS transistor 2. In the differential amplifier 12, a feedback loop in which the current $I_3$ is converted at the resistor 7 into the voltage $V_{R1}$ to be returned to input is formed.

The current $I_3$ output from the differential amplifier 12 is fed back to input of the differential amplifier 12. In an equilibrium state (steady state) of the feedback loop at a temperature used as reference, the reference voltage circuit of the first embodiment is stable when a voltage at the drain terminal of the NMOS transistor 1 and a voltage at the drain terminal of the NMOS transistor 2 are equal to each other, and the current $I_1$, the current $I_2$, and the current $I_3$ are equal to one another. In short, a relationship of Expression (1) is established.

$$I_1 = I_2 I_3 \tag{1}$$

The NMOS transistor 1 and the NMOS transistor 2 are driven by the current source circuit 9 to operate in a weak inversion region. A MOS transistor operating in a weak inversion region is expressed, as indicated by Expression (2), in a form in which a drain current $I_d$ is in proportion to an exponent of a gate-source voltage $V_{gs}$. This relationship is known to be a characteristic close to the relationship of the collector current of a bipolar transistor to the base-emitter voltage which is used as a reference of the voltage in the BGR circuit of the related art. That is, this property can be utilized to generate, with the use of a MOS transistor, a reference voltage that is stable with respect to temperature changes as in a BGR circuit of the related art, without using a bipolar transistor.

$$I_d \cong I_s \frac{W}{L} \exp\left[\frac{q(V_{gs} - V_{th})}{n \cdot k \cdot T}\right] \tag{2}$$

In Expression (2):

k represents the Boltzmann constant of 1.38E-23 [J/K], q represents the amount of electron charge of 1.6E-19 [C], T represents the absolute temperature [K], n represents a slope factor (a constant, normally from about 1 to 2), $I_s$ represents a constant determined by process, $V_{gs}$ represents the gate-source voltage, and $V_{th}$ represents a threshold voltage of the MOS transistor.

In FIG. 1, the NMOS transistor 1 and the NMOS transistor 2 are equal to each other in threshold voltage $V_{th}$ and channel length (L). The channel width (W) of the NMOS transistor 1 is denoted by W1 and the channel width (W) of the NMOS transistor 2 is denoted by W2. As described above, the ratio of the channel width W1 and the channel width W2 is 1:M. The current $I_1$ is a current which flows in the NMOS transistor 1 in the differential amplifier 12. The current $I_2$ is a current which flows in the NMOS transistor 2 in the differential amplifier 12. Each of the current $I_1$ and the current $I_2$ is expressed by Expression (3) and Expression (4) because the NMOS transistors 1 and 2 operate in a weak inversion region.

$$I_1 \cong I_s \frac{W_1}{L} \exp\left[\frac{q(V_{gs1} - V_{th})}{n \cdot k \cdot T}\right] \tag{3}$$

-continued $$I_2 \cong I_s \frac{W_2}{L} \exp\left[\frac{q(V_{gs2} - V_{th})}{n \cdot k \cdot T}\right] = I_s \frac{M \cdot W_1}{L} \exp\left[\frac{q(V_{gs2} - V_{th})}{n \cdot k \cdot T}\right] \quad (4)$$

In Expression (3) and Expression (4):

$V_{gs1}$ represents the gate-source voltage of the NMOS transistor 1, $V_{gs2}$ represents the gate-source voltage of the NMOS transistor 2, and $V_{th}$ represents a threshold voltage of the NMOS transistors 1 and 2.

The voltage $V_{R1}$ between the terminals of the resistor 7 is a voltage that is a difference between the voltage $V_{gs1}$ of the NMOS transistor 1 and the voltage $V_{gs2}$ of the NMOS transistor 2. Expression (5) which expresses the voltage $V_{R1}$, is derived from Expression (3) and Expression (4). As for Expression (5), it is noted that "ln" in Expression (5) means "natural logarithm", i.e., ln(e)=1.

$$V_{R1} = \left[n\frac{k \cdot T}{q}\ln\left(\frac{I_1}{I_s} \cdot \frac{L}{W_1}\right) - V_{th}\right] - \left[n\frac{k \cdot T}{q}\ln\left(\frac{I_2}{I_s} \cdot \frac{L}{M \cdot W_2}\right) - V_{th}\right] = n\frac{k \cdot T}{q}\ln\left(\frac{W_2}{W_1}\right) = n\frac{k \cdot T}{q}\ln(M) \quad (5)$$

The current $I_3$ is a current flowing in the resistor 7 and is expressed by Expression (6).

$$I_3 = \frac{V_{R1}}{R_1} = \frac{n}{R_1} \cdot \frac{k \cdot T}{q}\ln(M) \quad (6)$$

In Expression (6), $R_1$ represents the resistance value of the resistor 7.

As is understood from Expression (6), the current $I_3$ is a proportional-to-absolute-temperature (PTAT) current, and is proportional to the absolute temperature T.

When the temperature changes from a reference temperature, the current $I_1$ and the current $I_2$ start to change because the absolute temperature T is included in the right-hand side of each of Expression (3) as to the current $I_1$ and Expression (4) as to the current $I_2$. However, in the reference voltage circuit of the first embodiment, the current $I_3$ is a PTAT current, and accordingly the voltage $V_{R1}$ between the terminals of the resistor 7 in which the current $I_3$ flows changes, and the voltage $V_{gs1}$ of the NMOS transistor 1 and the voltage $V_{gs2}$ of the NMOS transistor 2 change. The current $I_1$ and the current $I_2$ consequently become equal to each other, and the sum of the current $I_1$ and the current $I_2$ settles to a current value set by the current source circuit 9 and is stabilized.

The output voltage $V_{REF1}$ of the reference voltage circuit of the first embodiment is the sum of a gate-source voltage $V_{gs3}$ of the NMOS transistor 3, the voltage $V_{R1}$ between the terminals of the resistor 7, and the voltage $V_{R2}$ between the terminals of the resistor 8, and is expressed by Expression (7).

$$V_{REF1} = V_{gs3} + V_{R1} + V_{R2} = V_{gs3} + I_3(R_1 + R_2) = V_{gs3} + n \cdot \frac{R_1 + R_2}{R_1} \cdot \frac{k \cdot T}{q}\ln(M) \quad (7)$$

In Expression (7), $R_2$ represents the resistance value of the resistor 8.

The gate-source voltage $V_{gs3}$ which is the first term of Expression (7) is changed due to a temperature change generally by an amount that has a negative value of approximately −0.5 mV/K to −2 mV/K. The voltage $V_{R1}$ between the terminals of the resistor 7 and the voltage $V_{R2}$ between the terminals of the resistor 8, each of which is the second term of Expression (7), have a positive temperature coefficient because the current $I_3$ is a PTAT current. That is, in order to set a temperature coefficient of the output voltage $V_{REF1}$ qualitatively to zero, a circuit constant may be appropriately adjusted so that a temperature-induced change of the gate-source voltage $V_{gs3}$ of the NMOS transistor 3 is canceled out by temperature-induced changes of the voltage $V_{R1}$ between the terminals of the resistor 7 and the voltage $V_{R2}$ between the terminals of the resistor 8.

Expression (7) does not include a variable related to the power supply voltage VDD, and the output voltage $V_{REF1}$ is accordingly stable with respect to fluctuations in power supply voltage as well.

A condition for setting the first-order temperature coefficient of a temperature-induced fluctuation amount $\Delta V_{REF1}$ of the output voltage $V_{REF1}$ from the reference voltage circuit of the first embodiment to zero becomes clear from Expression (8) obtained by differentiating Expression (7) by the absolute temperature T.

$$\Delta V_{REF1} = \frac{\partial V_{gs3}}{\partial T} + n \cdot \frac{R_1 + R_2}{R_1} \cdot \frac{k}{q}\ln(M) \quad (8)$$

That is, the condition for setting the first-order temperature coefficient of the temperature-induced fluctuation amount $\Delta V_{REF1}$ to zero may be obtained by adjusting the value of $(R_1+R_2)/R_1$ and the value of M to appropriate values so that the first term of Expression (8) is canceled out by the second term of Expression (8). Here, the value of M is the ratio of the NMOS transistor 2 to the NMOS transistor 1 in channel width (W).

With the circuit configuration of the first embodiment, a circuit simulation was performed under conditions for a 0.18 μm CMOS process. Conditions of respective elements are as follows:

NMOS transistor 1: channel length (L)=5 μm, channel width (W)=16 μm

NMOS transistor 2: channel length (L)=5 μm, channel width (W)=64 μm

NMOS transistor 3: channel length (L)=100 μm, channel width (W)=1.2 μm

PMOS transistors 4, 5, and 6: channel length (L)=20 μm, channel width (W)=2.4 μm Resistor 7: $R_1$=6.2 MΩ, TC1=−5,100 ppm/K Resistor 8: $R_2$=22.9 MΩ, TC1=−5,100 ppm/K Circuit current: $I_1=I_2=I_3$=10 nA (when VDD=3 V and T=298 K)

(The circuit current is determined by the current source circuit 9.)

In this example, TC1 represents a first-order temperature coefficient of the resistors.

A curve 15 of FIG. 4 indicates temperature characteristics of the output voltage $V_{REF1}$ that is observed in the reference voltage circuit of the first embodiment when the power supply voltage VDD is 3 V. The output voltage $V_{REF1}$ is 1.203 V at 25° C. (=298 K), and a fluctuation range of the output voltage $V_{REF1}$ in a temperature range of from −20° C. to 100° C. is 8.55 mV.

A curve 18 of FIG. 5 indicates dependence of the output voltage $V_{REF1}$ on the power supply voltage VDD that is observed in the reference voltage circuit of the first embodiment when the temperature is 25° C. (298 K). The output voltage $V_{REF1}$ changes by 7.2 mV when the power supply voltage VDD changes from 1.2 V to 5 V.

Second Embodiment

A reference voltage circuit of a second embodiment of the present invention is described with reference to FIG. 2.

Figure 2:
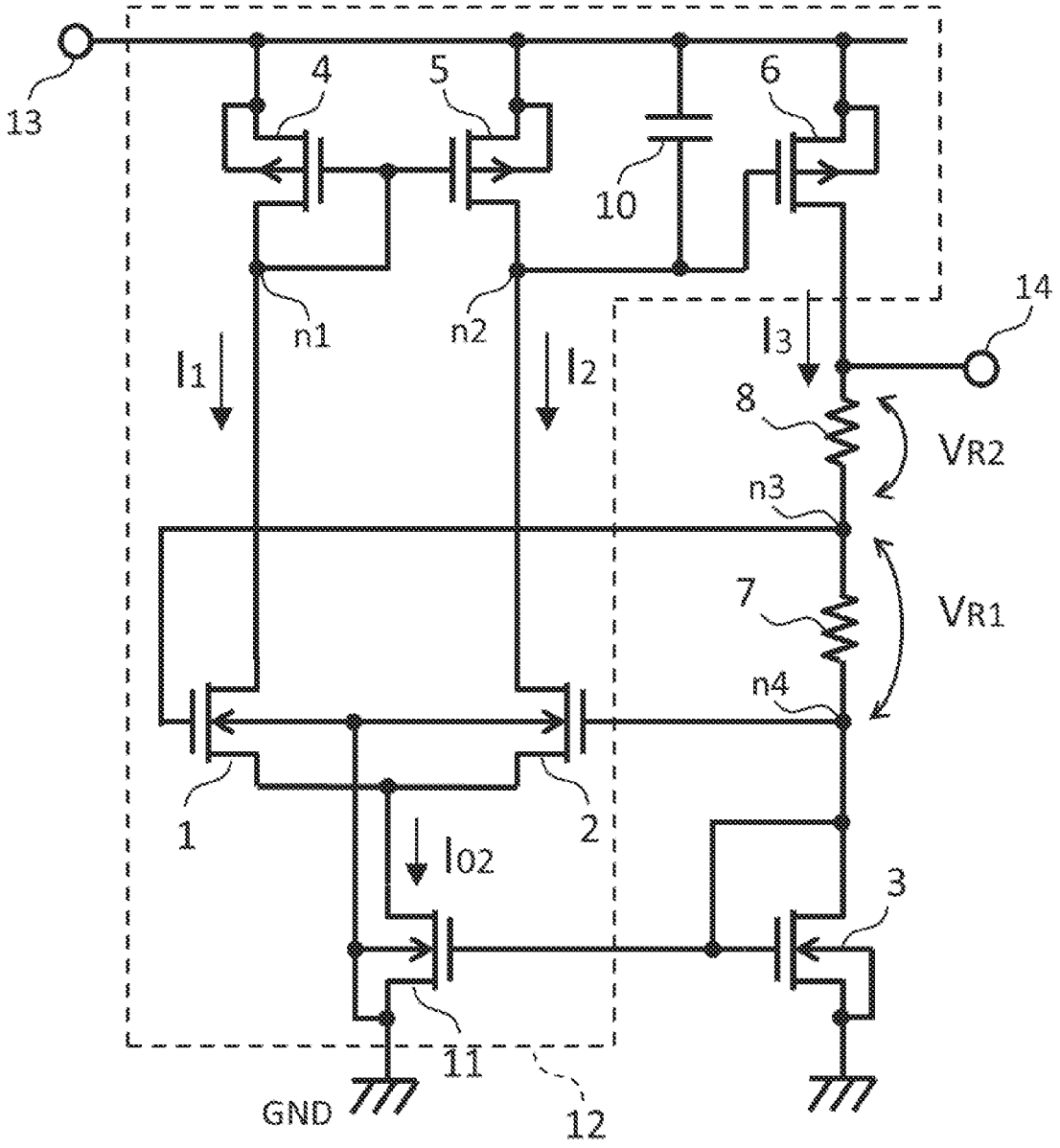
FIG. 2 is a circuit diagram for illustrating a configuration of a reference voltage circuit of a second embodiment of the present invention.

The reference voltage circuit illustrated in FIG. 2 has a configuration in which the current source circuit 9 of the reference voltage circuit of the first embodiment is replaced with an NMOS transistor 11.

The NMOS transistor 11 has a drain terminal connected to the source terminal of the NMOS transistor 1 and the source terminal of the NMOS transistor 2, a gate terminal connected to the gate terminal of the NMOS transistor 3, and a source terminal and a back gate terminal that are connected to the GND terminal.

The reference voltage circuit of the second embodiment is a circuit having a self-biased configuration that uses a current mirror circuit formed from the NMOS transistor 3 and the NMOS transistor 11 to feed the current $I_3$ on which the differential amplifier 12 itself is driven. Further, the current $I_3$ is supplied from the differential amplifier 12 and fed back as a current $I_{02}$. The reference voltage circuit of the second embodiment outputs the output voltage $V_{REF1}$.

The channel width (W) of the NMOS transistor 11 is set to twice the channel width (W) of the NMOS transistor 3, and the current $I_{02}$ is accordingly twice larger than the current $I_3$. When the reference voltage circuit of the second embodiment is in an equilibrium state (steady state) at a temperature used as a reference, a relationship "$I_1=I_2=I_3$" is established. That is, the reference voltage circuit of the second embodiment has a self-biased configuration, and can accordingly substitute the current source circuit 9 of the reference voltage circuit of the first embodiment with a small number of elements.

A conditional expression for setting the first-order temperature coefficient of $\Delta V_{REF1}$ to zero in the reference voltage circuit of the second embodiment is the same as that in the reference voltage circuit of the first embodiment. However, the current source circuit 9 of the reference voltage circuit of the first embodiment has a constant current, whereas the current $I_{02}$ of the reference voltage circuit of the second embodiment is a current proportional to the absolute temperature because the current $I_{02}$ is a feedback current of the PTAT current $I_3$ that is fed back by the current mirror circuit formed from the NMOS transistor 3 and the NMOS transistor 11. A circuit constant that sets the first-order temperature coefficient of the output voltage to zero therefore takes a value different from that in the circuit of the first embodiment as in an example described later.

With the circuit configuration of the second embodiment, a circuit simulation was performed under conditions for a 0.18 μm CMOS process. Conditions of respective elements are as follows:

NMOS transistor 1: channel length (L)=5 μm, channel width (W)=16 μm

NMOS transistor 2: channel length (L)=5 μm, channel width (W)=64 μm

NMOS transistor 3: channel length (L)=100 μm, channel width (W)=1.2 μm

NMOS transistor 11: channel length (L)=100 μm, channel width (W)=2.4 μm

PMOS transistors 4, 5, and 6: channel length (L)=20 μm, channel width (W)=2.4 μm Resistor 7: $R_1$=6.2 MΩ, TC1=−5,100 ppm/K Resistor 8: $R_2$=17.5 MΩ, TC1=−5,100 ppm/K Circuit current: $I_1=I_2=I_3$=10 nA (when VDD=3 V and T=298 K)

A curve 16 of FIG. 4 indicates temperature characteristics of the output voltage $V_{REF1}$ that is observed in the reference voltage circuit of the second embodiment when the power supply voltage VDD is 3 V. The output voltage $V_{REF1}$ is 1.148 V at 25° C., and a fluctuation range of the output voltage $V_{REF1}$ in a temperature range of from −20° C. to 100° C. is 7.10 mV.

A curve 19 of FIG. 5 indicates dependence of the output voltage $V_{REF1}$ on the power supply voltage VDD that is observed in the reference voltage circuit of the second embodiment when the temperature is 25° C. (298 K). The output voltage $V_{REF1}$ changes by 6.8 mV when the power supply voltage VDD changes from 1.2 V to 5 V.

Third Embodiment

A reference voltage circuit of a third embodiment of the present invention is described with reference to FIG. 3. The reference voltage circuit of the third embodiment is a circuit obtained by changing a place in which the gate terminal of the NMOS transistor 3 in the reference voltage circuit of the second embodiment is connected. The difference from the reference voltage circuit of the second embodiment is that the gate terminal of the NMOS transistor 3 is connected to the connection point n3 between the resistor 7, the resistor 8, and the gate terminal of the NMOS transistor 1. The reference voltage circuit of the third embodiment outputs an output voltage $V_{REF2}$.

Figure 3:
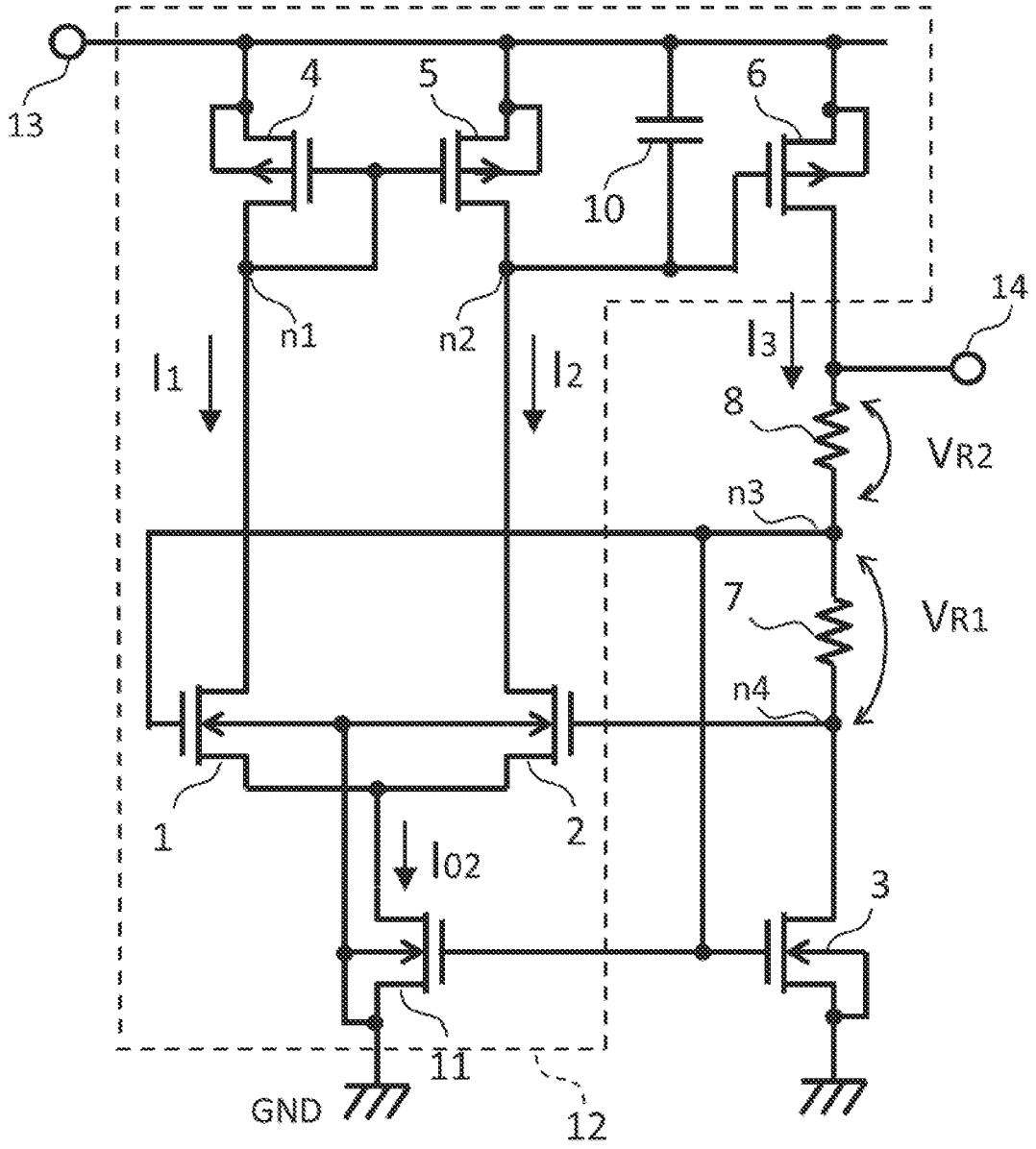
FIG. 3 is a circuit diagram for illustrating a configuration of a reference voltage circuit of a third embodiment of the present invention.
Figure 6:
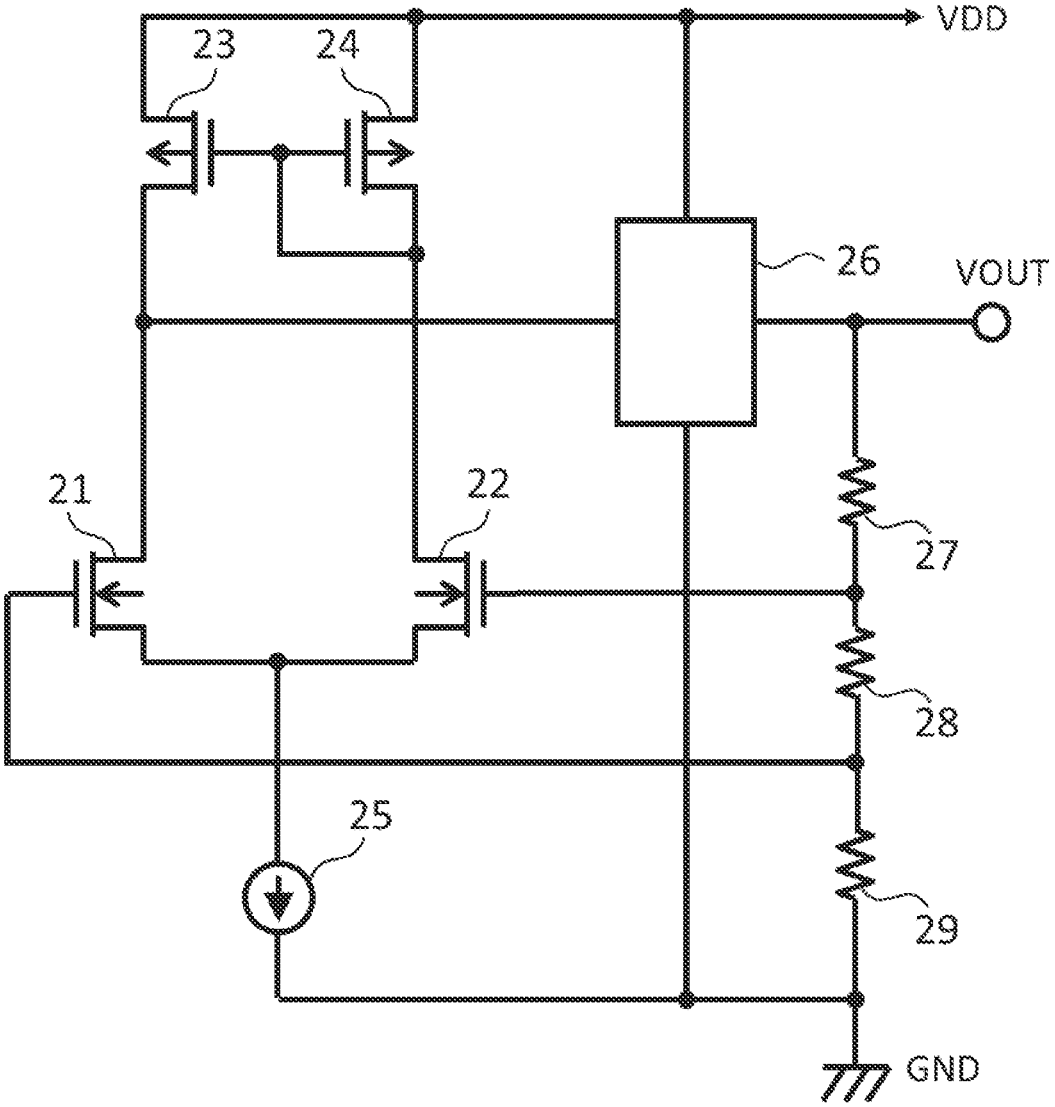
FIG. 6 is a circuit diagram for illustrating a configuration of a reference voltage circuit of the related art.

The current source circuit illustrated in FIG. 3 as the current source circuit in the third embodiment has the same circuit configuration as that in the second embodiment, but may have the same circuit configuration as that in the first embodiment. An output voltage in that case differs from the output voltage of the current source circuit in the third embodiment has the same circuit configuration as that in the second embodiment as with the output voltage of the first embodiment and the output voltage of the second embodiment which differ from each other.

The NMOS transistor 3 and the NMOS transistor 11 form a current mirror circuit in which, as in the second embodiment, the channel width (W) of the NMOS transistor 11 is set to twice the channel width (W) of the NMOS transistor 3, and the current $I_{02}$ is accordingly twice larger than the current $I_3$. When the reference voltage circuit of the third embodiment is in an equilibrium state (steady state) at a temperature used as a reference, a relationship "$I_1=I_2=I_3$" is established.

In the reference voltage circuit of the third embodiment, a potential at the connection point n3 is fixed to the gate-source voltage $V_{gs3}$ of the NMOS transistor 3, and the connection point n3 is accordingly kept to a voltage that is lower than that in the reference voltage circuit of the second embodiment. The reference voltage circuit of the third embodiment is therefore required to adjust the channel length (L) and channel width (W) of the NMOS transistor 3 so that the gate-source voltage $V_{gs3}$ of the NMOS transistor 3 is high enough for the NMOS transistor 1, the NMOS transistor 2, and the NMOS transistor 11 to operate well. In order to satisfy this condition, the reference voltage circuit of the third embodiment controls the NMOS transistor 3 (and the NMOS transistor 11) to operate in a saturation region, and thus sets $V_{gs3}$ of the NMOS transistor 3 to a voltage that is higher than the threshold voltage $V_{th}$ by about 0.3 V.

The output voltage $V_{REF2}$ of the reference voltage circuit of the third embodiment is a voltage that is the sum of the gate-source voltage $V_{gs3}$ of the NMOS transistor 3 and the voltage $V_{R2}$ between the terminals of the resistor 8, and is expressed by Expression (9).

$$V_{REF2} = V_{gs3} + V_{R2} = V_{gs3} + I_3 \cdot R_2 = V_{gs3} + n \cdot \frac{R_2}{R_1} \cdot \frac{k \cdot T}{q} \ln(M) \quad (9)$$

A temperature-induced fluctuation amount $\Delta V_{REF2}$ of the output voltage $V_{REF2}$ from the reference voltage circuit of the third embodiment is obtained by differentiating Expression (9) by the absolute temperature T. The temperature-induced fluctuation amount $\Delta V_{REF2}$ is expressed as Expression (10).

$$\Delta V_{REF2} = \frac{\partial V_{gs3}}{\partial T} + n \cdot \frac{R_2}{R_1} \cdot \frac{k}{q} \ln(M) \quad (10)$$

The first term on the right-hand side of Expression (10), i.e., $(\partial V_{gs3})/(\partial T)$ is a temperature-induced change amount of the gate-source voltage $V_{gs3}$ of the NMOS transistor 3. A first-order temperature coefficient of the output voltage $V_{REF2}$ is set to zero by adjusting the value of $(R_2/R_1)$ and the value of M to appropriate values so that the first term of Expression (10) is canceled out by the second term of Expression (10). Here, the value of M is the ratio of the NMOS transistor 2 to the NMOS transistor 1 in channel width (W). A reference voltage that is stable regardless of temperature fluctuations is thus obtained.

With the circuit configuration of the third embodiment, a circuit simulation was performed under conditions for a 0.18 μm CMOS process. Conditions of respective elements are as follows:

NMOS transistor 1: channel length (L)=5 μm, channel width (W)=16 μm

NMOS transistor 2: channel length (L)=5 μm, channel width (W)=64 μm

NMOS transistor 3: channel length (L)=100 μm, channel width (W)=1.2 μm

NMOS transistor 11: channel length (L)=100 μm, channel width (W)=2.4 μm

PMOS transistors 4, 5, and 6: channel length (L)=20 μm, channel width (W)=2.4 μm Resistor 7: $R_1$=6.2 MΩ, TC1=−5,100 ppm/K Resistor 8: $R_2$=23.2 MΩ, TC1=−5,100 ppm/K Circuit current: $I_1=I_2=I_3$=10 nA (when VDD=3 V and T=298 K)

A curve 17 of FIG. 4 indicates temperature characteristics of the output voltage $V_{REF2}$ that is observed in the reference voltage circuit of the third embodiment when the power supply voltage VDD is 3 V. The output voltage $V_{REF2}$ is 1.144 V at 25° C., and a fluctuation range of the output voltage $V_{REF2}$ in a temperature range of from −20° C. to 100° C. is 7.03 mV.

A curve 20 of FIG. 5 indicates dependence of the output voltage $V_{REF2}$ on the power supply voltage VDD that is observed in the reference voltage circuit of the third embodiment when the temperature is 25° C. (298 K). The output voltage $V_{REF2}$ changes by 6.6 mV when the power supply voltage VDD changes from 1.2 V to 5 V.

FIG. 4 is a graph for showing temperature characteristics of the output voltages $V_{REF1}$ and $V_{REF2}$ with the circuit configurations of the first to third embodiments when the power supply voltage VDD is 3 V. In FIG. 4, fluctuation ranges of the output voltages in a temperature range of from −20° C. to 100° C. are equivalent to an output voltage fluctuation range in a BGR circuit of the related art, such as a BGR circuit including a bipolar transistor.

FIG. 5 is a graph for showing characteristics of the output voltages $V_{REF1}$ and $V_{REF2}$ with respect to fluctuations of the power supply voltage VDD with the circuit configurations of the first to third embodiments at a temperature of 25° C. In a region in which the power supply voltage VDD is 1.2 V or higher, the circuit of any of the first to third embodiments has an output voltage that is substantially constant. This simulation result indicates that the circuits of the first to third embodiments keep output voltages stable and function as reference voltage circuits even when the power supply voltage VDD widely changes.

In addition, the total current consumption is as small as 30 nA in the circuit of any of the first to third embodiments. Power consumed when the power supply voltage VDD is 1.5 V which is the voltage of a single dry-cell battery required to function as a reference voltage circuit is only 45 nW.

As described above, the reference voltage circuits of the first to third embodiments operate on a minute current, and can generate a voltage that is as stable as that of a BGR circuit of the related art with respect to temperature fluctuations. That is, the reference voltage circuits of the first to third embodiments are reference voltage circuits that satisfy requirements of an IoT device at the same time.

Although the description has been given of a setting example in which the transistors are varied in channel width (W), the channel widths (W) of the transistors may equivalently be varied by connecting a plurality of transistors in parallel and changing the number of transistors connected in parallel. The number of transistors connected in parallel can be changed by fabricating a large number of transistors in advance and removing some of the transistors by laser trimming or other methods.

In the descriptions of the first to third embodiments, the operation has been described based on the circuits having a form in which the back gate of a MOS transistor is connected to the GND terminal or the power supply terminal 13. However, the same characteristics are obtained even with a circuit having a form in which the back gate is connected to the drain of its own MOS transistor with the use of a special CMOS process that can separate the back gate from a substrate potential.

What is claimed is:

1. A reference voltage circuit, comprising:

a first MOS transistor, a second MOS transistor, a third MOS transistor, a fourth MOS transistor, a fifth MOS transistor, and a sixth MOS transistor;

a first resistor and a second resistor;

a current source circuit; and an output terminal, wherein the first MOS transistor and the second MOS transistor each have a source terminal to be connected to a first terminal of the current source circuit, wherein the second resistor has a first terminal to be connected to a drain terminal of the sixth MOS transistor and to the output terminal, and a second terminal to be connected to a gate terminal of the first MOS transistor and to a first terminal of the first resistor, wherein the first resistor has a second terminal to be connected to a gate terminal of the second MOS transistor and to a drain terminal and a gate terminal of the third MOS transistor, wherein the third MOS transistor has a source terminal to be connected to a first predetermined potential, and the current source circuit has a second terminal to be connected to the first predetermined potential, wherein the fourth MOS transistor has a drain terminal and a gate terminal that are to be connected to a drain terminal of the first MOS transistor and to a gate terminal of the fifth MOS transistor, respectively, wherein the fifth MOS transistor has a drain terminal to be connected to a drain terminal of the second MOS transistor and to a gate terminal of the sixth MOS transistor, and wherein the fourth MOS transistor, the fifth MOS transistor, and the sixth MOS transistor each have a source terminal to be connected to a second predetermined potential.

2. A reference voltage circuit, comprising:

a first MOS transistor, a second MOS transistor, a third MOS transistor, a fourth MOS transistor, a fifth MOS transistor, and a sixth MOS transistor;

a first resistor and a second resistor;

a current source circuit; and an output terminal, wherein the first MOS transistor and the second MOS transistor each have a source terminal to be connected to a first terminal of the current source circuit, wherein the second resistor has a first terminal to be connected to a drain terminal of the sixth MOS transistor and to the output terminal, and a second terminal to be connected to a gate terminal of the first MOS transistor, to a gate terminal of the third MOS transistor, and to a first terminal of the first resistor, wherein the first resistor has a second terminal to be connected to a gate terminal of the second MOS transistor and to a drain terminal of the third MOS transistor, wherein the third MOS transistor has a source terminal to be connected to a first predetermined potential, and the current source circuit has a second terminal to be connected to the first predetermined potential, wherein the fourth MOS transistor has a drain terminal and a gate terminal that are to be connected to a drain terminal of the first MOS transistor and to a gate terminal of the fifth MOS transistor, wherein the fifth MOS transistor has a drain terminal to be connected to a drain terminal of the second MOS transistor and to a gate terminal of the sixth MOS transistor, and wherein the fourth MOS transistor, a fifth MOS transistor, and the sixth MOS transistor each have a source terminal to be connected to a second predetermined potential.

3. The reference voltage circuit according to claim 1, wherein the first MOS transistor and the second MOS transistor each are configured to operate in a weak inversion region.

4. The reference voltage circuit according to claim 2, wherein the first MOS transistor and the second MOS transistor each are configured to operate in a weak inversion region.

5. The reference voltage circuit according to claim 1, wherein the current source circuit is a seventh MOS transistor which forms a current mirror circuit together with the third MOS transistor.

6. The reference voltage circuit according to claim 2, wherein the current source circuit is a seventh MOS transistor which forms a current mirror circuit together with the third MOS transistor.

* * * * *